United States Patent [19]

Hilding

[11] 3,965,994

[45] June 29, 1976

[54] MAGAZINE FOR STORING DRILL STRING ELEMENTS

[75] Inventor: Jonas Olof Anders Hilding, Nacka, Sweden

[73] Assignee: Atlas Copco Aktiebolag, Nacka, Sweden

[22] Filed: Dec. 16, 1974

[21] Appl. No.: 533,133

[30] Foreign Application Priority Data

Dec. 21, 1973 Sweden ..... 7317340

[52] U.S. Cl. ..... 175/52; 175/85; 211/60 S

[51] Int. Cl.[2] ..... E21B 9/14

[58] Field of Search ..... 175/52, 85; 211/60 S; 214/2.5, 1 P

[56] References Cited

UNITED STATES PATENTS

| | | | |
|---|---|---|---|
| 2,235,265 | 3/1941 | Shope | 211/60 S |
| 3,265,138 | 8/1966 | Alexander et al. | 175/85 X |
| 3,506,075 | 4/1970 | Attebo | 175/52 |
| 3,768,663 | 10/1973 | Turner et al. | 175/85 X |

*Primary Examiner*—Frank L. Abbott
*Assistant Examiner*—Richard E. Favreau
*Attorney, Agent, or Firm*—Flynn & Frishauf

[57] ABSTRACT

A magazine, adapted for use in a rock drilling rig, comprises means for spacing two adjacent drill rods. The spacing means includes turnstiles which are journalled rotatably in the magazine. The turnstiles are arranged to be rotated by the drill rods when the latter are moved into or out of the magazine.

13 Claims, 9 Drawing Figures

14
15
24
II
II
26
25
27
12
26
23
VIII
VIII
22
13
290
20
11
10
16
21
17
18
19

29
23
28
30

III
III
31
59
56
L
0
14
72
66
76
25
77
85

30
38
39

52
29
48
49
41
45
51
50
42
44
52
43
30
40

MAGAZINE FOR STORING DRILL STRING ELEMENTS

This invention relates to a drill rod handling apparatus, and in particular to a magazine for storing drill rods. The apparatus comprises a rock drilling machine movable to and fro along a feed bar, a magazine at the side of the feed bar and means for transferring the drill rods between the magazine and the drill axis. In the magazine, there are provided means for spacing two adjacent drill rods.

In magazines for drill pipes, it is previously known to arrange therein movable means adapted to prevent the pipes from falling out. In one known magazine, disclosed in U.S. Pat. No. 3,286,777, the drill pipes are secured by means of locking devices arranged swingably in the upper portion of the magazine. The locking devices can be pivoted up manually by means of ropes. U.S. Pat. No. 3,501,017 discloses a magazine in which the drill pipes are secured by means of hydraulically operated, swingable locking devices. In another construction, disclosed in U.S. Pat. No. 2,507,040, a drill pipe is locked by means of a yoke which is swingable between two extreme positions.

It is an object of the present invention to design the spacing means in such a way that on the one hand a correct distance between two adjacent rods is obtained, and on the other said spacing means are rotated by the rods during the movement of the latter into or out of the magazine. Furthermore, the spacing means shall prevent the rods from falling out of the magazine unintentionally.

SUMMARY OF THE INVENTION

According to one aspect of the invention there is provided a drill string element handling apparatus comprising an elongated support, a drilling machine mounted on said support for reciprocal movement therealong, a plurality of drill string elements for making up a drill string, said drill string being connectable at one end thereof to said drilling machine to be driven longitudinally with respect to said support, a magazine for storing said drill string elements laterally seriatim with respect to the axis of said drill string, means for transferring said drill string elements to and from said axis, wherein the apparatus includes turnstile means in said magazine, said turnstile means being journalled rotatably alongside the row of the drill string elements, and wherein wing means are provided on said turnstile means for spacing adjacent drill string elements stored in said magazine.

According to another aspect of the invention there is provided an improved magazine for storing drill rods laterally seriatim with respect to the axis of a string made up of a plurality of drill rods, wherein the improvement comprises turnstile means in said magazine, said turnstile means being journalled rotatably alongside the row of drill rods, and wing means on said turnstile means for spacing adjacent drill rods.

The above and other objects of the invention will become apparent from the following description and from the accompanying drawing in which one embodiment of the invention is shown by way of example. It is to be understood that this embodiment is only illustrative to the invention and that various modifications thereof may be made within the scope of the claims following hereinafter.

DETAILED DESCRIPTION

Figure 1:
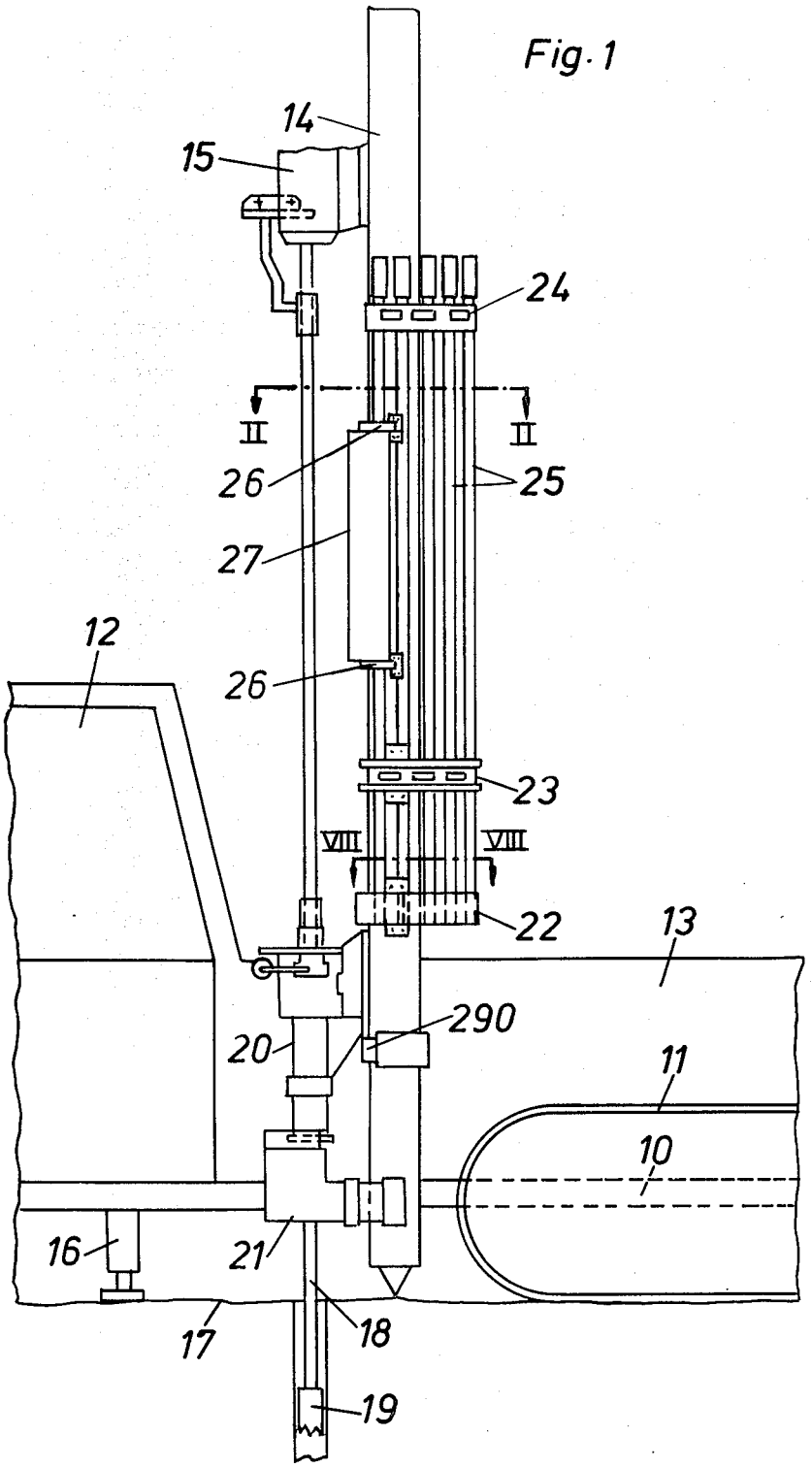
FIG. 1 shows diagrammatically a side view of a crawler mounted rock drilling rig with a magazine for drill rods according to the invention.

In FIG. 1, a drill rig is diagrammatically shown, having a chassis 10, crawlers 11, an operator's cab 12, a machinery housing 13 accomodating a Diesel engine, hydraulic pumps and a compressor unit, and a feed bar 14. A rock drilling machine 15, preferably hydraulic, is in known manner movable along the feed bar 14. During drilling, the chassis 10 is raised from the ground 17 by means hydraulic hudraulic levelling jacks 16. A magazine for drill rods 25 comprising three axially spaced members 22, 23 and 24 is mounted beside the feed bar 14. The drill rods are moved one by one between the magazine and the drill axis by means of a swingable transferring arm 26 with a spinning device 27 for gripping and rotating the rods turnably journalled in the outer end. At the front end of the feed bar 14 there is a drill rod centralizer 20 for a string 18 of connected extension rods. The drill rod centralizer 20 is mounted on a slide which is freely slidable along the feed bar. In FIG. 1, the drill rod centralizer is shown in a rear position where it can be locked by means of hydraulically operated lugs 290. At either side of the feed bar there is a drill bit changing device 21 swingably journalled in such a way that it can be swung to the drill axis, when the drill rod centralizer 20 is in the shown position and the drill bit 19 drawn up thereinto.

Figure 2:
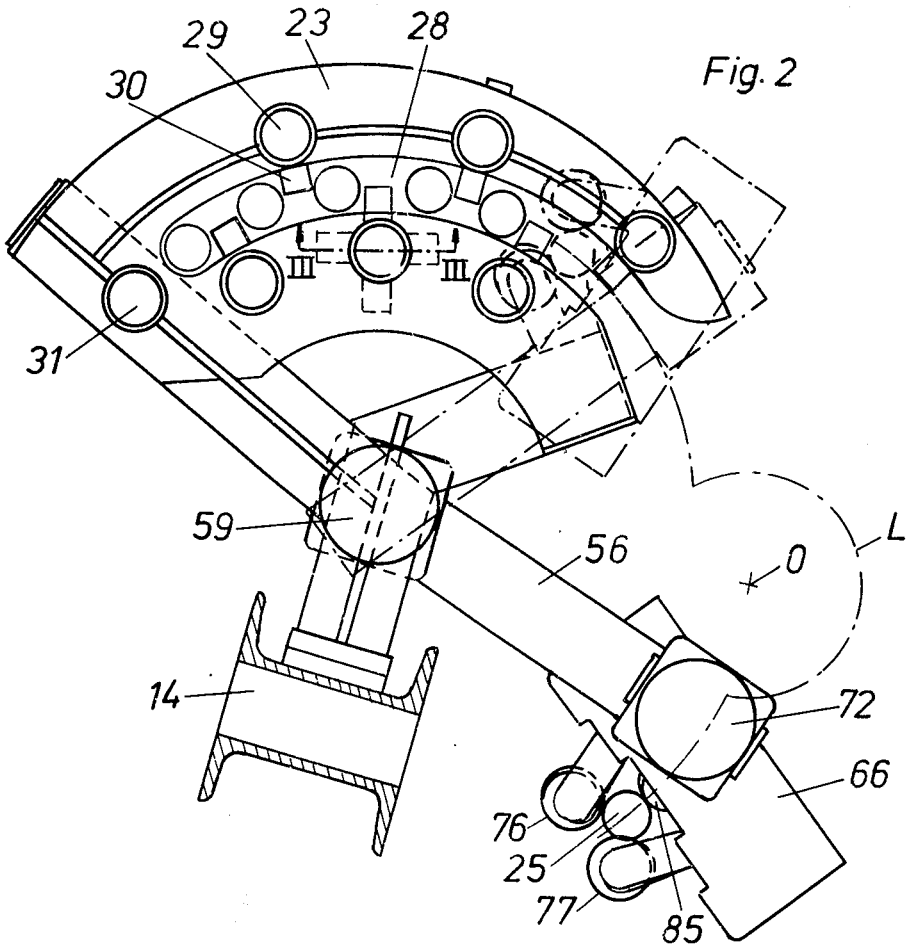
FIG. 2 shows, partly in section, a transferring arm for drill rods and the magazine, taken on the line II—II in FIG. 1.

As may be seen in FIG. 2 the magazine member 23 attached to the feed bar 14 is provided with an arcuate channel 28. An arm 56 is swingable by means of a hydraulic motor 59. The arm 56 carries a gripping tong 66 for drill rods. The gripping tong is turnable by means of the hydraulic motor 72. The gripping tong is designed as three mutually opposed rollers 76, 77, 85 resting against a drill rod 25. The arm 56 transfers during its swinging the drill rod along the line L between the drill axis and the magazine. The rollers 76 and 77 are arranged on the outer end of swingable arms. The roller 85 is reversibly driven by means of a motor (not shown). The axes of the rollers are inclined with respect to the drill axis, whereby the drill rod during rotation thereof will be moved axially. To understand the present invention, it is not necessary to describe the transferring arm 56 and the gripping tong 66 in detail. A more detailed description thereof will be found in the Swedish patent application no. 7317338-7, wherein the drill rod centralizer 20 and the drill bit changing device 21 are also described.

As may be seen in FIG. 2 the magazine member 23 attached to the feed bar 14 is provided with an arcuate channel 28. A bar 31 is placed outside the bottom of the channel on the extension of the circle arc extending between the upper member 24 (FIG. 1) of the magazine and the bottom 22 (FIG. 1). On both sides of the channel 28, turnstiles 29 are rotatably journalled. Each turnstile is provided with four pins 30, each of which separates two consecutive rods. The turnstiles 29 are journalled alternately on the one side and on the other of the channel 28 from the opening to the bottom thereof. The turnstiles 29 are rotated by the rods 25 at the transferring of the rods into or out of the magazine. The upper member 24 (FIG. 1) of the magazine is designed in the same manner as the member 23.

Figure 8:
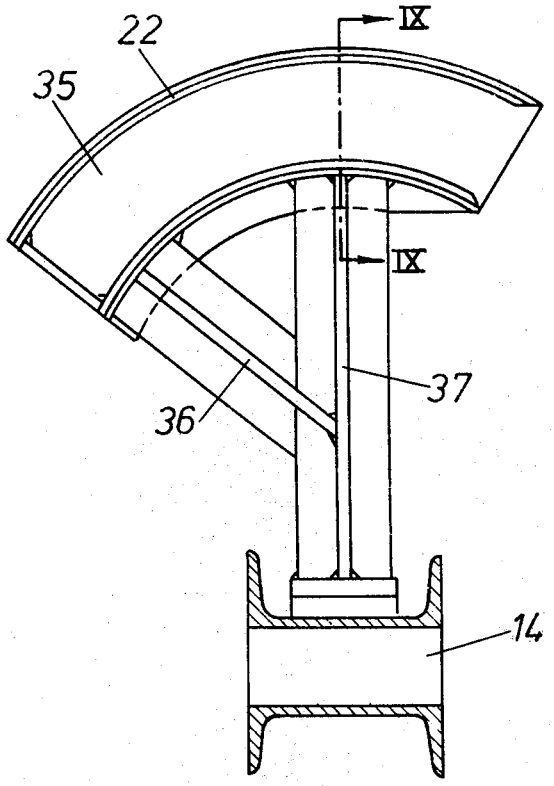
FIG. 8 shows a top view of the magazine bottom, taken on the line VIII—VIII in FIG. 1.
Figure 9:
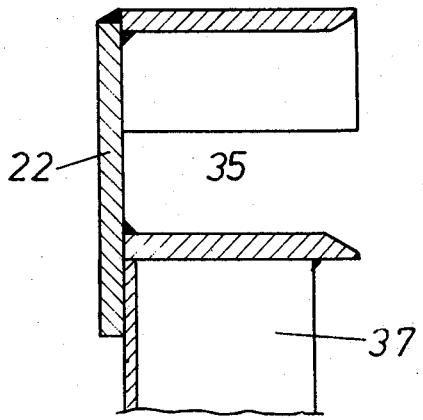
FIG. 9 is a section through the magazine bottom, taken on the line IX—IX in FIG. 8.

In FIGS. 8 and 9, the bottom member 22 of the magazine is shown. The bottom member, which in conformity with the members 23 and 24 of the magazine is attached to the feed bar 14, is stiffened by means of flanges 36 and 37. The rods 25 are stored in an up-right position standing against the plane bottom surface in an arcuate channel 35 designed with an U-shaped cross section.

Figure 3:
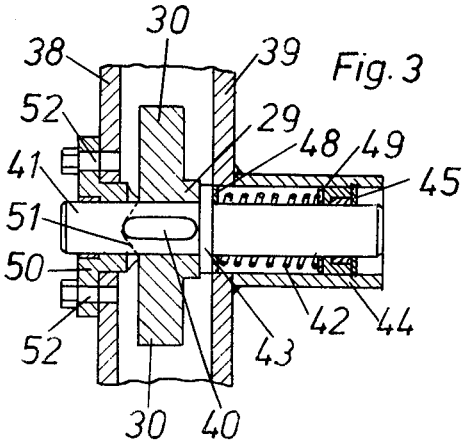
FIG. 3 is a section through a turnstile with pins for separating two consecutive rods, taken on the line III—III in FIG. 2.
Figure 5:
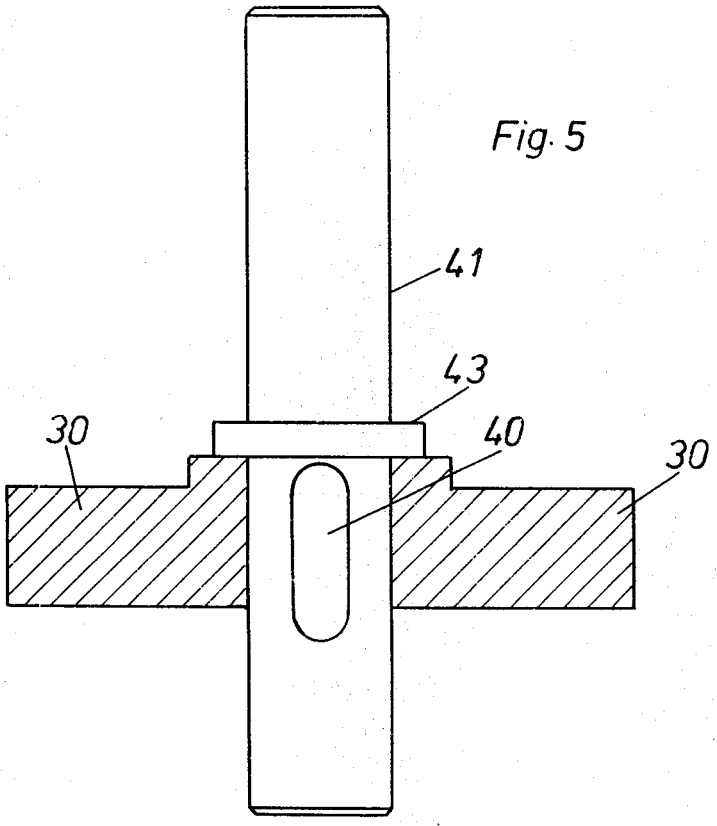
FIG. 5 is a section through the turnstile, taken on the line V—V in FIG. 4.
Figure 4:
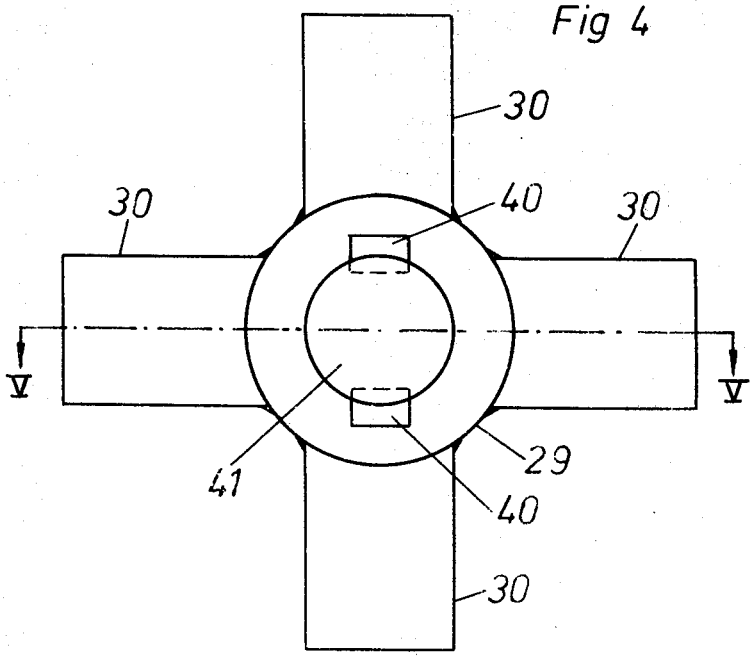
FIG. 4 shows a view seen from below of the turnstile mounted on a shaft.
Figure 7:
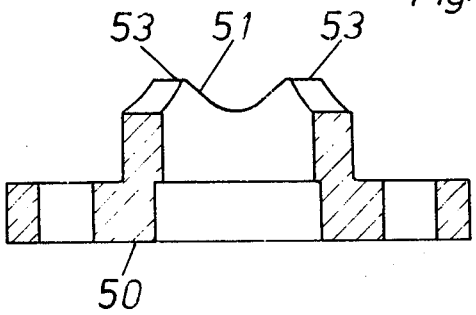
FIG. 7 shows a section through the journal bearing, taken on the line VII—VII in FIG. 6.
Figure 6:
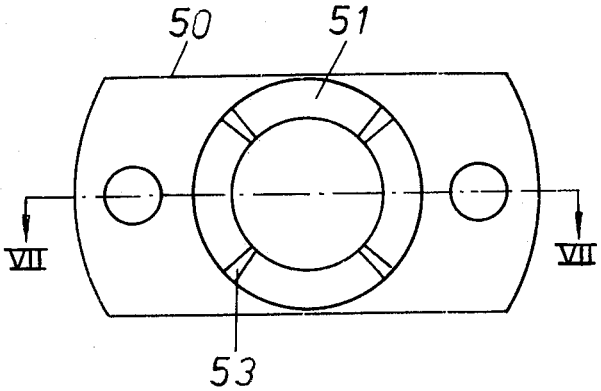
FIG. 6 shows a top view of a journal bearing for said shaft.

As evident from the section through a turnstile 29 shown in FIG. 3, the latter is journalled between two parallel plates 38 and 39. Th turnstile 29 is designed with four radially extending pins 30, which are equally spaced circumferentially. The turnstile 29 is attached to a shaft 41 by means of wedges 40. A tube 44 is affixed to the plate 39. Between a collar 43 on the shaft 41 and a lock ring 45 fastened in the tube 44 there is provided a spring 42. At both sides of the spring between the latter and respectively the collar 43 and the lock ring 45 there are slide rings 48 and 49 respectively. A plate 50 providing a bearing bushing is attached to the plate 38 by means of bolts 52. The end of the turnstile 29 which faces the plate 50 is provided with a waved cam profile 51, see FIGS. 6 and 7. The wedges 40 extend forwardly of the turnstile 29, see FIGS. 4 and 5, and are biased against the cam profile 51 by the spring 42. The cam profile 51 is provided with four tops and four bottoms. When the turnstiles 29 are in the position shown in FIGS. 2 and 3, the wedge 40 rests against the bottom in the cam profile 51. If a rod 25 is moved into or out of the magazine, the rod will turn the turnstile 29 by the contact with a pin 30. The wedge 40, then, will slide along the cam profile 51 and contract the spring 42. The turnstile 29 is turned by the rod until the wedge 40 passes a top on the cam profile 51. The continued turning of the turnstile until the wedge reaches the bottom immediately following in the cam profile is carried out by extension of the contracted spring 42. The spring force is so suited that it is great enough to prevent the rods from falling out of the magazine unintentionally, for instance when the feed bar 14 is inclined.

The rods are transferred into the magazine in the following manner. A rod is moved as far into the magazine as possible. When the magazine is empty, the rod is moved to the bottom of the magazine channel. The rod is held on place by a pin 30 on the turnstile next behind. The rod coming next is moved until it abuts this pin and is held in this position by a pin on the following turnstile and so on until the magazine is filled.

The invention is not limited to the embodiment shown in the drawing as an example but can be varied within the scope of the claims following hereinafter without departing from the inventive concept. The invention may as well be applied in different types of magazines, for instance in magazines where the rods are arranged along a straight line and the transferring arm is displaceable instead of turnable. The invention may also be applied in rotatable magazines.

What I claim is:

1. A drill string element handling apparatus comprising:

an elongated support (14), a drilling machine (15) mounted on said support (14) for reciprocal movement therealong, a plurality of drill string elements (25) for making up a drill string, said drill string being connectable at one end thereof to said drilling machine (15) to be driven longitudinally with respect to said support (14), a magazine (22, 23, 24) for storing a plurality of said drill string elements laterally seriatim in a row with respect to the axis of said drill string, means (26, 27) for transferring said drill string elements to and from said axis, turnstile means (29) in said magazine, said turnstile means (29) being journalled rotatably alongside the row of stored drill string elements, wing means (30) on said turnstile means for spacing adjacent string elements stored in said magazine, and means for moving said drill string elements along a path in said magazine, and for rotating said turnstile means during movement of said drill string elements along said path.

2. An apparatus according to claim 1, comprising locking means at least on said turnstile means to lock said turnstile means by snap action in a rotational position where two adjacent drill string elements are spaced apart by said wing means, whereby to retain said drill string elements in position.

3. An apparatus according to claim 2, wherein said turnstile means includes a plurality of turnstiles with wing means, said turnstiles being arranged alternately at either side of the moving path of said drill string elements.

4. An apparatus according to claim 2, wherein said locking means comprises a guiding means (40) attached to said turnstile means, and a circular, waved cam profile (51) located in said magazine such that said guiding means slides along said cam profile.

5. An apparatus according to claim 4, comprising biasing means (42) mounted in said magazine for biasing said guiding means (40) against said cam profile (51).

6. An apparatus according to claim 4 wherein said turnstile means includes a plurality of turnstiles with wing means, each turnstile including a guiding means (40) which is slidable along said cam profile (51).

7. An apparatus according to claim 1, wherein said magazine comprises two axially spaced brackets (23, 24) independently mounted on said support, and said turnstile means comprises turnstiles rotatably journalled in both of said brackets, each of said turnstiles including wing means.

8. An apparatus according to claim 7, wherein said magazine further comprises a bottom member (22)

having a channel (35) for supporting said drill string elements.

9. An improved magazine for storing drill rods comprising means for carrying drill rods laterally seriatim with respect to the axis of a string made up of a plurality of drill rods, and means for orienting a plurality of drill rods in a row, the improvement comprising:

turnstile means (29) in said magazine, said turnstile means being journalled rotatably alongside the row of drill rods, wing means (30) on said turnstile means for spacing adjacent drill rods; and means at least in said magazine for locking said turnstile means by snap action in rotational positions where two adjacent drill rods are spaced apart by said wing means, whereby to retain said drill rods in position.

10. A magazine according to claim 9, wherein said locking means comprises a waved cam profile (51) in said magazine, sliding means (40) on a turnstile means adapted to slide along said cam profile, and means (42) in said magazine for biasing said turnstile means against said cam profile, said cam profile (51) being provided with bottom portions and top portions of equal number.

11. A magazine according to claim 10, wherein said cam profile (51) has four bottom portions, and wherein said turnstile means is locked when said sliding means (40) is in engagement with any of said bottom portions of said cam profile.

12. A magazine according to claim 10, comprising a shaft rotatably journalled in said magazine, and wherein said sliding means (40) comprises a wedge adapted to attach said turnstile means to said shaft, said wedge projecting outwardly of said turnstile means.

13. A magazine according to claim 10 wherein said turnstile means includes a plurality of turnstiles with wing means, each turnstile including a sliding means (40) which is slidable along said cam profile (51).

* * * * *